US011235581B2

(12) United States Patent
Leiser et al.

(10) Patent No.: US 11,235,581 B2
(45) Date of Patent: Feb. 1, 2022

(54) PRINT LIQUID INTERCONNECTS WITH ROTARY MOTION DAMPER

(71) Applicant: HEWLETT-PACKARD DEVELOPMENT COMPANY, L.P., Spring, TX (US)

(72) Inventors: Judson M. Leiser, Corvallis, OR (US); James Ring, Corvallis, OR (US); Jeffrey L. Thielman, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/607,976

(22) PCT Filed: Jul. 13, 2018

(86) PCT No.: PCT/US2018/042049

§ 371 (c)(1),
(2) Date: Oct. 24, 2019

(87) PCT Pub. No.: WO2020/013859

PCT Pub. Date: Jan. 16, 2020

(65) Prior Publication Data

US 2021/0291541 A1 Sep. 23, 2021

(51) Int. Cl.
*B41J 2/175* (2006.01)

(52) U.S. Cl.
CPC ..... *B41J 2/17526* (2013.01); *B41J 2/17513* (2013.01)

(58) Field of Classification Search
CPC ..... B41J 2/17526; B41J 2/17513
USPC ..... 347/86
See application file for complete search history.

(56) References Cited

U.S. PATENT DOCUMENTS

| | | | | |
|---|---|---|---|---|
| 6,027,209 | A | 2/2000 | Menendez et al. | |
| 6,074,042 | A | 6/2000 | Gasvoda et al. | |
| 6,997,548 | B2 | 2/2006 | Matsuo et al. | |
| 7,284,830 | B2 | 10/2007 | Sasaki et al. | |
| 7,798,622 | B2 | 9/2010 | Silverbrook | |
| 7,942,509 | B2 | 5/2011 | Kobayashi | |
| 9,340,029 | B2 | 5/2016 | Naito et al. | |
| 9,746,815 | B2 | 8/2017 | Carpenter et al. | |
| 2008/0002003 | A1* | 1/2008 | Kobayashi | B41J 2/1752 347/86 |

(Continued)

FOREIGN PATENT DOCUMENTS

| | | | |
|---|---|---|---|
| CN | 101254699 | A | 9/2008 |
| CN | 105882147 | A | 8/2016 |
| CN | 207028528 | U | 2/2018 |

(Continued)

*Primary Examiner* — Kristal Feggins
*Assistant Examiner* — Alexander D Shenderov
(74) *Attorney, Agent, or Firm* — Fabian VanCott

(57) ABSTRACT

In one example in accordance with the present disclosure, an interconnect on a print liquid supply is described. The interconnect includes a liquid interface to establish a liquid path between the print liquid supply and an ejection device in which the print liquid supply is installed. The interconnect also includes an electrical interface to establish a data transmission path between the print liquid supply and the ejection device. The interconnect also includes an external surface having a dampening element disposed thereon.

20 Claims, 12 Drawing Sheets

(56) References Cited

U.S. PATENT DOCUMENTS

2008/0122905 A1* 5/2008 Silverbrook ..... B41J 29/026
347/86

FOREIGN PATENT DOCUMENTS

| | | | |
|---|---|---|---|
| EP | 0705694 | A2 | 4/1996 |
| EP | 0919386 | A2 | 6/1999 |
| JP | 2006231524 | A | 9/2006 |
| KR | 100768828 | B1 | 10/2007 |
| WO | WO2018022037 | A1 | 2/2018 |

* cited by examiner

PRINT LIQUID INTERCONNECTS WITH ROTARY MOTION DAMPER

BACKGROUND

Ejection devices operate to dispense a liquid onto a substrate surface. For example, a printer may operate to dispense print liquid such as ink onto a surface such as paper in a predetermined pattern. In another example, an additive manufacturing liquid is dispensed as part of an additive manufacturing operation. The print liquid is supplied to such ejection devices from a reservoir or other supply. That is, a print liquid supply reservoir holds a volume of print liquid that is passed to the fluidic ejection device and ultimately deposited on a surface. In some examples, the print liquid supplies are a separate component, i.e., removable, from the ejection device.

BRIEF DESCRIPTION OF THE DRAWINGS

The accompanying drawings illustrate various examples of the principles described herein and are part of the specification. The illustrated examples are provided for illustration, and do not limit the scope of the claims.

Figure 1A:
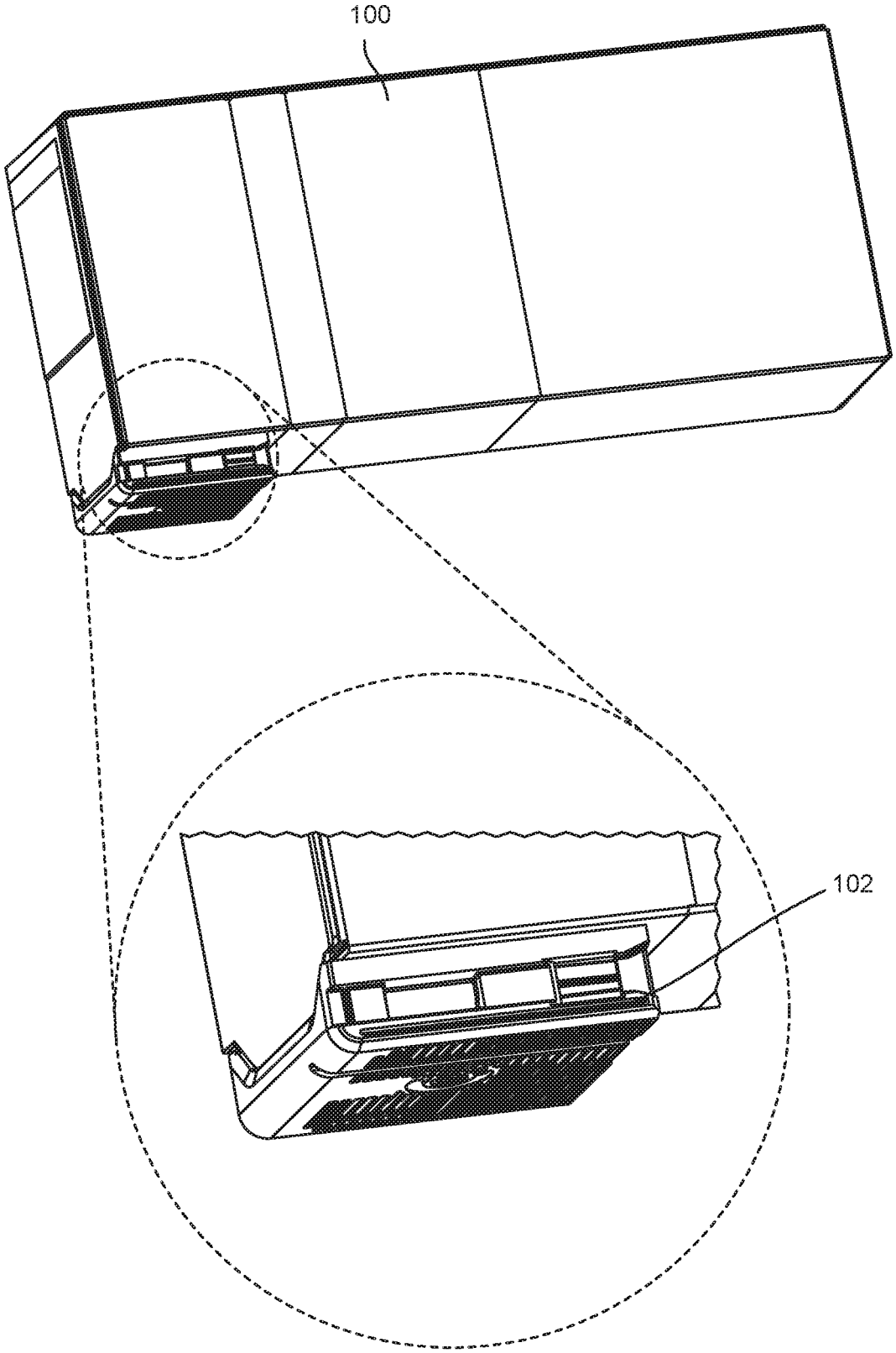
FIGS. 1A-1E depict an interconnect on a print liquid supply, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, liquid such as print liquid in a printer and an additive manufacturing liquid in a 3D printer, is supplied to an ejection device from liquid supplies. Before the ejection device can eject the liquid, a fluidic connection is established between the print liquid supply and the ejection device. Accordingly, the present specification describes an interconnect on a print liquid supply and a corresponding interconnect on a printer. When joined, the interconnects establish a path wherein liquid passes from the print liquid supply to the ejection device. For example, the printer interconnect receives the print liquid supply and includes a needle to be inserted into the interconnect of the print liquid supply.

While such interconnects are efficient at easily coupling a removable print liquid supply to an ejection device, some characteristics may complicate their use. For example, the ejection device may include a mechanism to eject the print liquid supply. Specifically, a spring-based latch may, upon activation by a user, eject the print liquid supply. It may also be the case that a common interconnect is used across various sizes of print liquid supplies. In such a system, the ejection force, or the force with which the print liquid supply is ejected from the ejection device, is defined based on a mass of the largest supply. Such an ejection force defined by a large supply, may be too much for a small supply. Such an ejection force could cause the small supply to eject at a great velocity or force. Such an ejection could 1) lead to a dissatisfying customer experience, 2) cause the small supply to launch onto the floor, 3) damage the print liquid supply and/or components of the ejection device, and in some cases 4) cause injury to an operator.

Accordingly, the present specification describes a motion damper to reduce the ejection velocity of a print liquid supply that is mated with an ejection device. Specifically, the interconnect on the printer includes a motion damper that interfaces with a feature of the interconnect on the print liquid supply to resist the ejection force and thereby reduce the ejection velocity. In one specific example, the motion damping system includes a rack and pinion system with the pinion being a geared tooth on the interconnect of the ejection device that resists the ejection force from a spring-based ejection component and the rack being a series of slots on a surface of the interconnect on the print liquid supply that interfaces with the geared tooth.

Specifically, the present specification describes an interconnect on a print liquid supply. The interconnect includes a liquid interface to establish a liquid path between the print liquid supply and an ejection device in which the print liquid supply is installed. The interconnect also includes an electrical interface to establish a data transmission path between the print liquid supply and the ejection device. The interconnect on the print liquid supply also includes an external surface having a dampening element disposed thereon.

In any example, the dampening element is disposed across a length of the external surface to facilitate dampening of the supply at ejection. In any example, the dampening element is disposed across at least fifty percent of the length of the external surface. In any example, the dampening element includes a number of slots. In any example the slots are disposed across an entirety of the external surface. In any example, the slots are disposed across just a portion of the external surface that interfaces with a rotary motion damper. In any example, the slots are a rack of a rack and pinion motion damper. In any example, the dampening element is a friction surface. In any example, the dampening element is a relief surface.

In any example, the interconnect also includes a guide feature to align the print liquid supply during installation into the ejection device. In any example, the interconnect includes protrusions to match keyed slots in an ejection device interconnect and to act upon rods in the ejection device interconnect when matched with corresponding keyed slots. In any example, a size and shape of the protrusions are unique to the keyed slots.

The present specification also describes an interconnect on an ejection device. The ejection device interconnect includes a needle to be inserted into a print liquid supply to allow print liquid from the print liquid supply to pass to the ejection device. The ejection device interconnect also includes an electrical interface to establish a data transmission path between the print liquid supply and the ejection device. The ejection device interconnect includes a rotary motion damper to dampen, via a controlled counter-rotation, a tangential force.

In any example, the rotary motion damper is a geared tooth, rubber surface, grit wheel, or knurled wheel. In any example, the rotary motion damper dampens the tangential force via a coil spring or a greased shaft.

In any example, the ejection device interconnect includes a retractable plate. When a print liquid supply is not present, the retractable plate extends past the needle and electrical interface to protect from mechanical damage. When a print liquid supply is inserted, the retractable plate retracts to 1) expose the needle to the print liquid supply and 2) expose the electrical interface to a corresponding interface on the print liquid supply. In this example, the ejection device interconnect includes a latch assembly actuated by insertion of the protrusions in the two keyed slots. The latch assembly controls the movement of the retractable plate.

In any example, the ejection device interconnect includes two keyed slots disposed on either side of the needle to gate insertion to a print liquid supply with protrusions that match the two keyed slots. The two keyed slots are to 1) allow matching protrusions to act upon the rods and 2) prevent non-matching protrusions from acting upon the rods. In any example, the needle, electrical interface and two keyed slots extend from the same plane and the rotary motion damper is disposed below the plane. In any example, the ejection device interconnect includes a guide feature adjacent the needle to align an incoming print liquid supply.

The present specification also describes a printing system. The printing system includes a printer and a print liquid supply. The printer includes an ejection device to deposit print liquid onto a substrate and a controller to control operation of the ejection device to deposit the print liquid in a desired pattern. The printer also includes an ejection device interconnect that includes a needle and an electrical interface to establish a data transmission path between the print liquid supply and the ejection device. The ejection device interconnect also includes a rotary motion damper to dampen, via a controlled counter-rotation, a tangential force. The print liquid supply of the system includes a reservoir to hold the print liquid and a supply interconnect. This interconnect includes a liquid interface to establish a liquid path between the print liquid supply and an ejection device in which the print liquid supply is installed and an electrical interface to establish a data transmission path between the print liquid supply and the ejection device. This interconnect also includes a number of slots formed on an external surface of the interconnect. The slots on the supply interconnect and the rotary motion damper on the device interconnect form a rack and pinion.

In any example, the rack and pinion slow the ejection speed of the print liquid supply and/or slow the insertion speed of the print liquid supply. In any example, the print liquid is an additive manufacturing fabrication agent and/or the print liquid is ink.

Such an interconnect system 1) accommodates connection between a printer and any number of print liquid supplies with different volumes, 2) presents the same user experience during ejection of a print liquid supply regardless of the supply size and mass and, 3) provides for simple coupling of a print liquid supply to a printer.

As used in the present specification and in the appended claims, the term "supply interconnect" and "print liquid supply interconnect" refer to the interconnect on the print liquid supply. Similarly, the term "ejection device interconnect" and "device interconnect" refer to the interconnect on the ejection device in the printer that mates with the supply interconnect.

Also, as used in the present specification and in the appended claims, the term "print liquid supply" refers to a device that holds a print liquid. For example, the print liquid supply may be a pliable reservoir.

Accordingly, a print liquid supply includes a container, carton or other housing for the print liquid supply. For example, the print liquid supply container may be a cardboard box in which the pliable containment reservoir is disposed.

Still further, as used in the present specification and in the appended claims, the term "print liquid" refers to a liquid deposited by an ejection device and can include, for example, ink or an additive manufacturing fabrication agent. Still further, as used in the present specification and in the appended claims, the term "fabrication agent" refers to any number of agents that are deposited and includes for example a fusing agent, an inhibitor agent, a binding agent, a coloring agent, and/or a material delivery agent. A material delivery agent revers to a fluid carrier that includes suspended particles of at least one material used in the additive manufacturing process.

Turning now to the figures, FIGS. 1A-1E depict a supply interconnect (102) on a print liquid supply (100), according to an example of the principles described herein. As described above, a print liquid supply (100) refers to a device that holds print liquid. The print liquid may be any type including ink for 2D printing and/or an additive manufacturing fabrication agent. The print liquid supply (100) may take many forms. For example, the print liquid supply (100) may include a pliable reservoir that conforms to the contents disposed therein. Because a pliable reservoir is difficult to handle and manipulate, it may be disposed in a rigid container, for example a corrugated fiberboard carton.

Coupled to the print liquid supply (100) is a supply interconnect (102). The supply interconnect (102) may be formed of any material such as a thermoplastic and may provide connectivity between the print liquid supply (100) and the ejection device to which it is coupled. For example, over time, the print liquid within the print liquid supply (100) may become depleted such that a new print liquid supply is coupled to the ejection device. Accordingly, the print liquid supply includes the supply interconnect (102) to facilitate the removal of the print liquid supply and to facilitate delivery of the print liquid to the ejection device. Accordingly, the supply interconnect (102) provides a liquid interface to establish a liquid path between the print liquid supply (100) and an ejection device in which the print liquid supply is installed. For example, the supply interconnect (102) may include an opening to the reservoir in the print liquid supply (100) and channels that direct incoming liquid through the supply interconnect (102) and out an opening to the ejection device. In some examples, the opening to the ejection device may have a port or closing such that when the print liquid supply (100) is not disposed in a printer, the liquid therein does not leak out.

Figure 3:
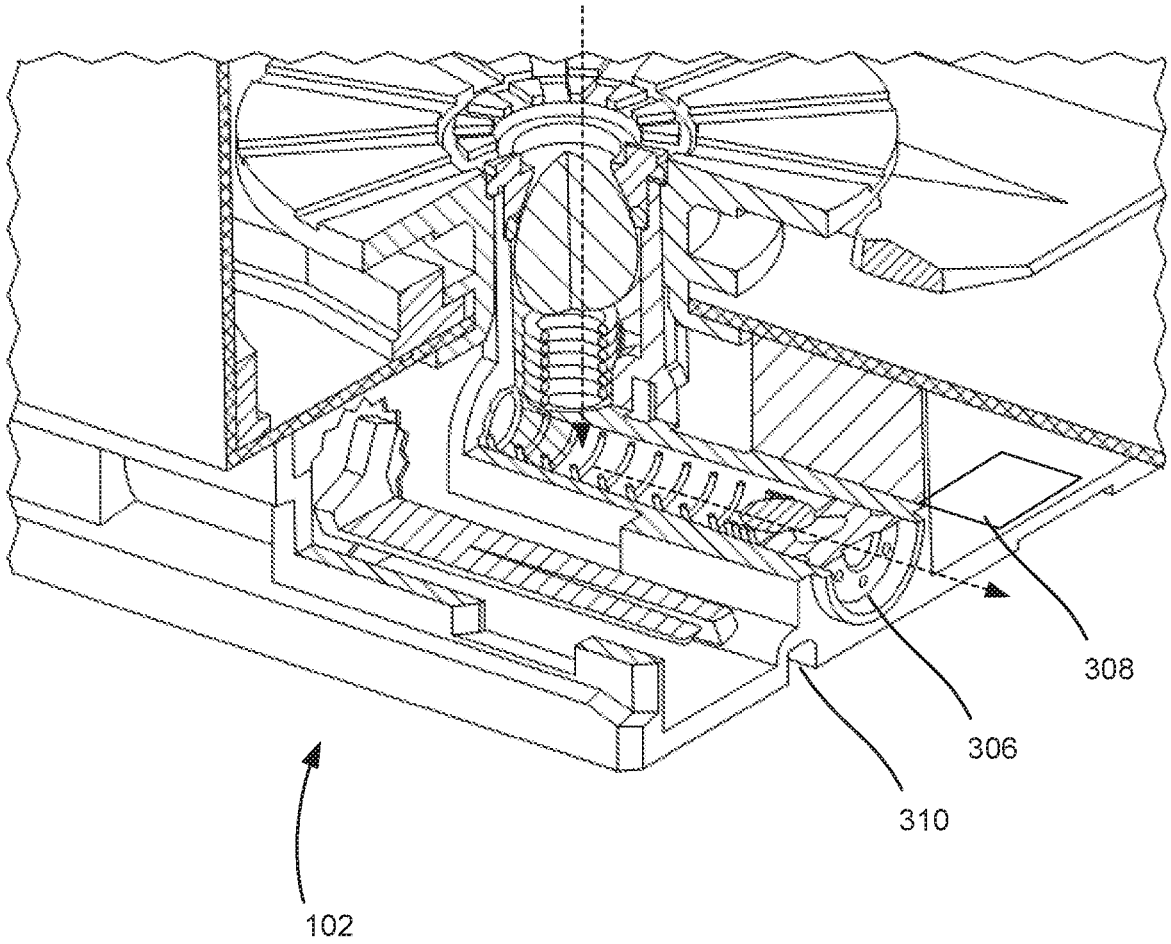
FIG. 3 is a cross-sectional view of an interconnect on a print liquid supply, according to an example of the principles described herein.

The supply interconnect (102) also includes an electrical interface to establish a data transmission path between the print liquid supply (100) and the ejection device. Many different types of data may be transmitted via this connection. For example, information regarding a formulation of the ink, a level of fluid within the print liquid supply (100), etc. may be included on a chip of the print liquid supply (100). This information may be passed to the printer to verify the print liquid supply (100), authenticate the print liquid supply (100), or to adjust the operation of fluidic ejection in order to optimize the performance. While specific reference is made to particular pieces of information, additional pieces of data can also be transferred via the electrical interface (108). FIG. 3 provides an example of the liquid interface and the electrical interface described herein.

The supply interconnect (102) also includes a component to reduce the ejection velocity of the print liquid supply (100) from an ejection device, Specifically, the printing device may have a number of ports, with each port being able to receive print liquid supplies (100) of various volumes and form factors. Accordingly, a print liquid supply (100) of 100 mL and a print liquid supply (100) of 1000 mL may be inserted into the same port at different times. The print liquid supplies (100) engage and disengage through a push-push motion. A first push engages and latches the print liquid supply (100) for use by the printing device and a second push releases it. In this system, springs push against the print liquid supply (100) to move it out of the port when an operator executes the second push. Doing so releases the print liquid supply (100) and the compressed springs release and force the print liquid supply (100) out. As the springs are sized for the mass and friction of a full, or partially full, 1000 mL print liquid supply (100), they may act differently on a print liquid supply (100) that is 10 times smaller. Accordingly, the energy in the springs against the smaller mass of, for example, a 100 mL supply (100) may cause the smaller supply to translate much more suddenly and could be overpowered thus resulting in a poor experience for the operator.

Figure 1B:
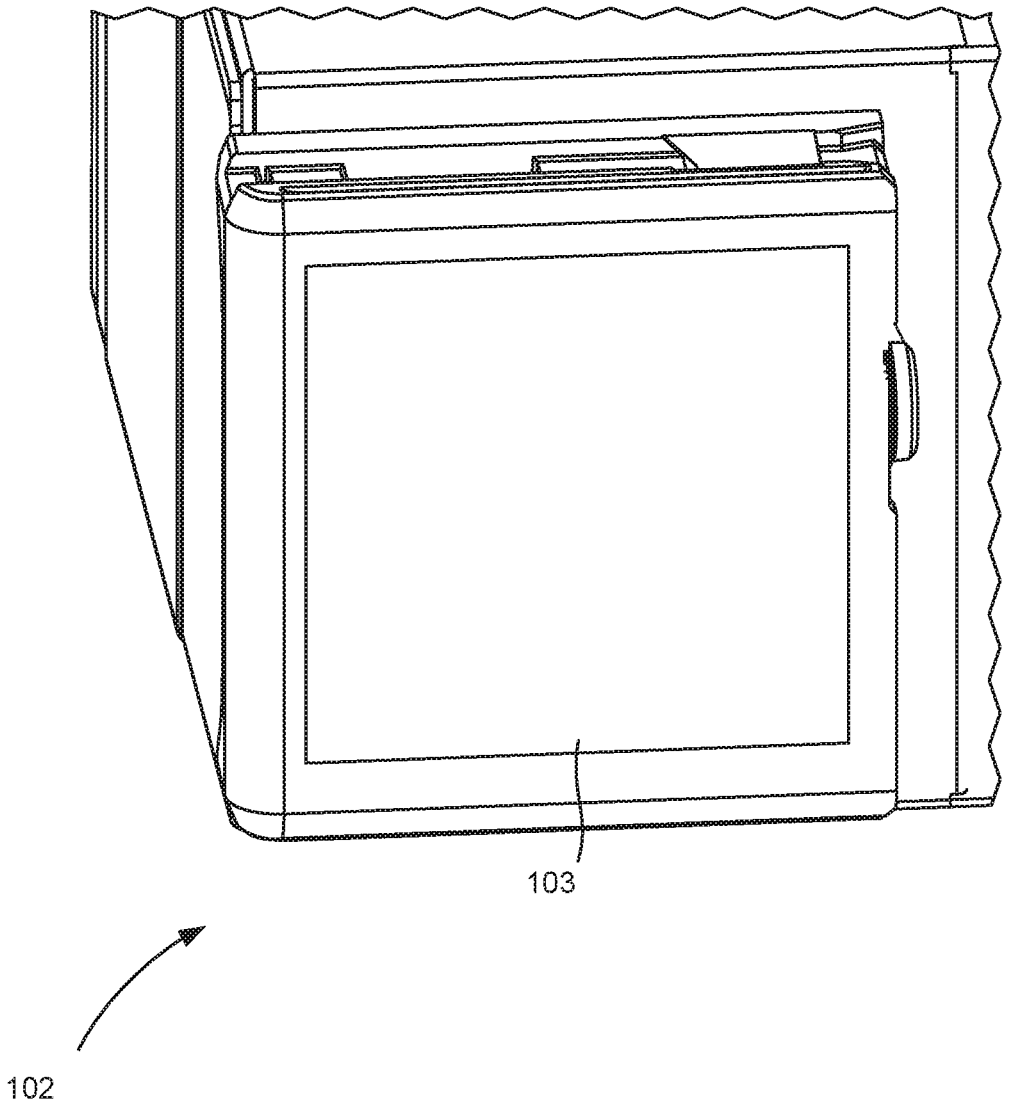

To account for the differing weights of different sized print liquid supplies (100), the supply interconnect (102) includes a component that in part, operates to reduce the ejection force. That is, the supply interconnect (102) includes a dampening element disposed on an external surface. The dampening element may take many forms. For example, as depicted in FIG. 1B, the dampening element may be a friction material (103). That is, a material (103) or film may be deposited on the supply interconnect (102). This material (103) may have a high coefficient of friction, such as rubber, to interface with a rotary motion device to reduce the ejection force of a print liquid supply.

Figure 1C:
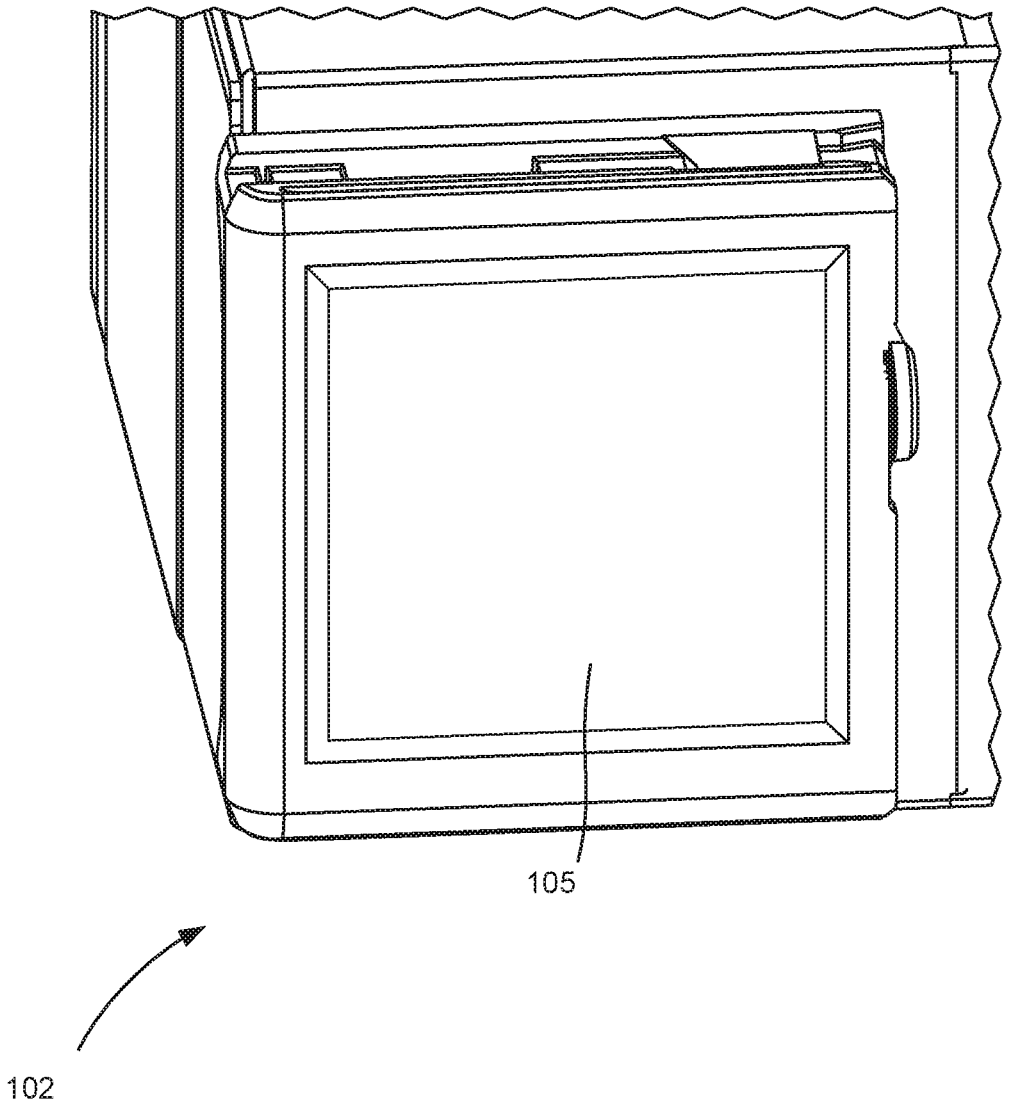

In another example, as depicted in FIG. 1C, the dampening element may be a relief surface (105). That is, a relief, or raised structure (105) may be disposed on the external surface. Such a relief structure (105) interfaces with motion damper on an ejection interface to reduce the ejection force of the print liquid supply. While FIG. 1C depicts a particular relief surface (105) topography, any topography may be used as a relief surface (105) to counter the ejection force of the print liquid supply.

Figure 1D:
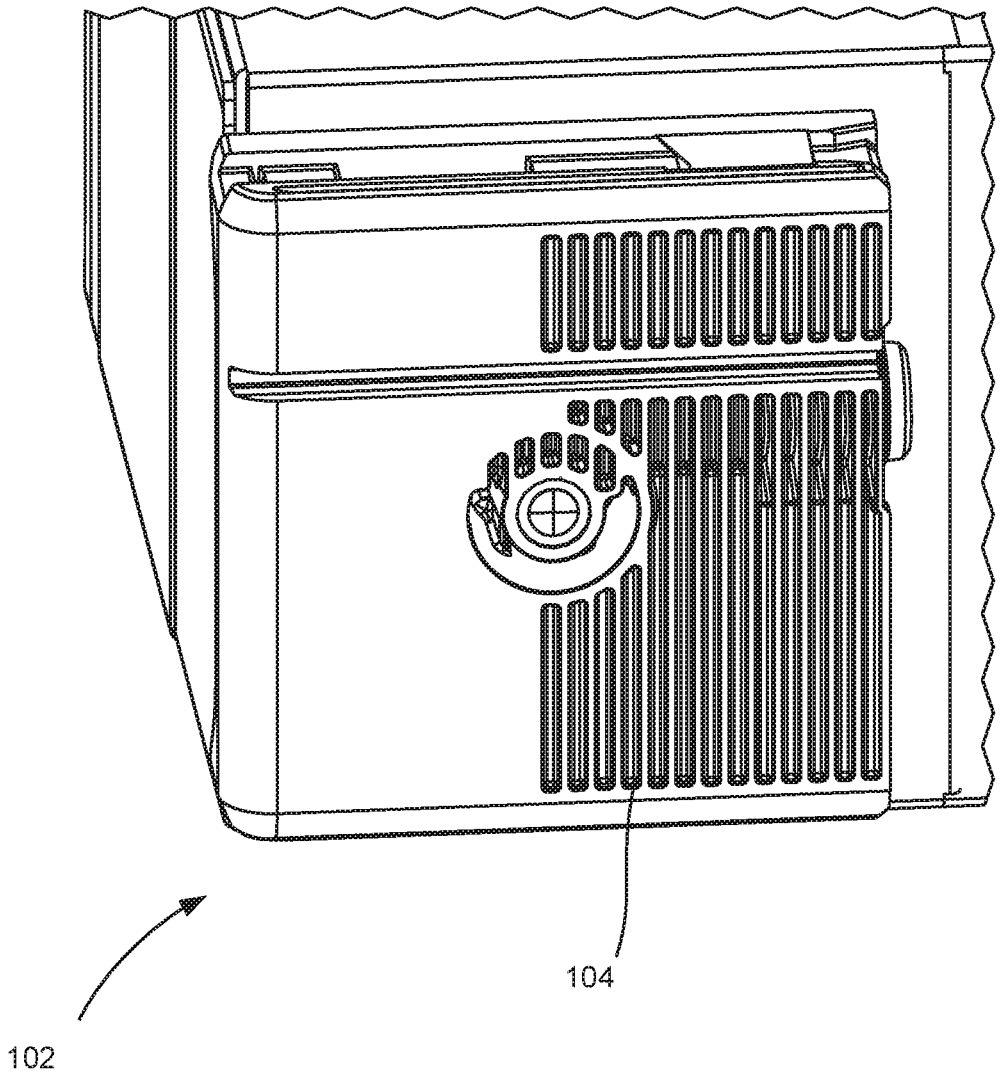

As depicted in FIG. 1D, the dampening element may be a number of slots (104) on an external surface of the supply interconnect (102). These slots (104) interface with a motion damper on an ejection interface to reduce the ejection force of a print liquid supply. For simplicity, just one instance of a slot (104) is referenced with a number in FIG. 1D. While FIGS. 1B and 1C depict the friction material (103) and relief surface (105) disposed over the entirety of the external surface, in some examples the dampening element, in FIG. 1D depicted as a number of slots (104), is disposed across a portion of the length. For example, the dampening element may be disposed across at least fifty percent of the length of the external surface as depicted in FIG. 1D.

Figure 1E:
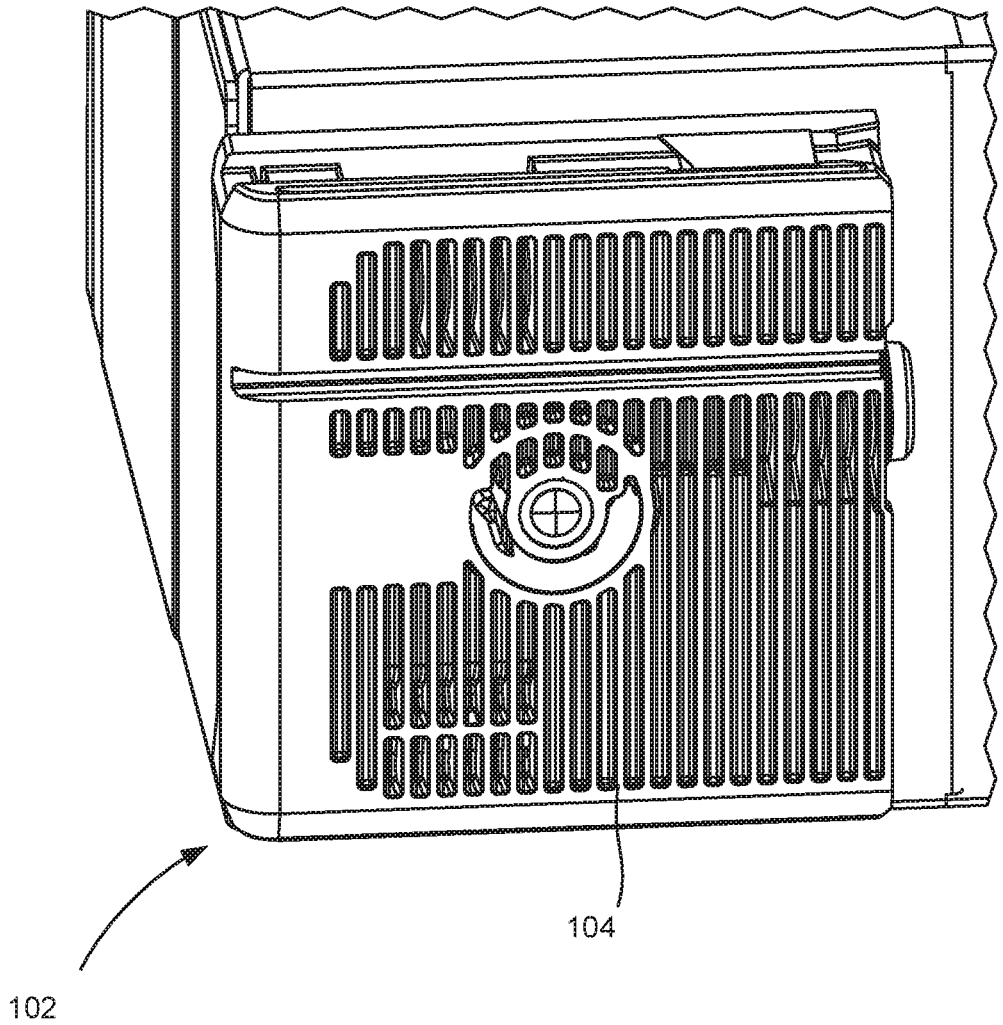

However, as can be seen in FIG. 1E, in some examples, the number of slots (104) are disposed across an entirety of the external surface. In another example, the number of slots (104) are disposed just across the portion of the external surface that interfaces with a rotary motion damper. The slots (104) act as a rack in a rack and pinion design. That is, the motion damper on the device interconnect may be a toothed gear that resists the ejection force of the springs. This resistance of force is translated to the supply interconnect (102) via the mechanical interface of the toothed gear and the number of slots (104).

Figure 2:
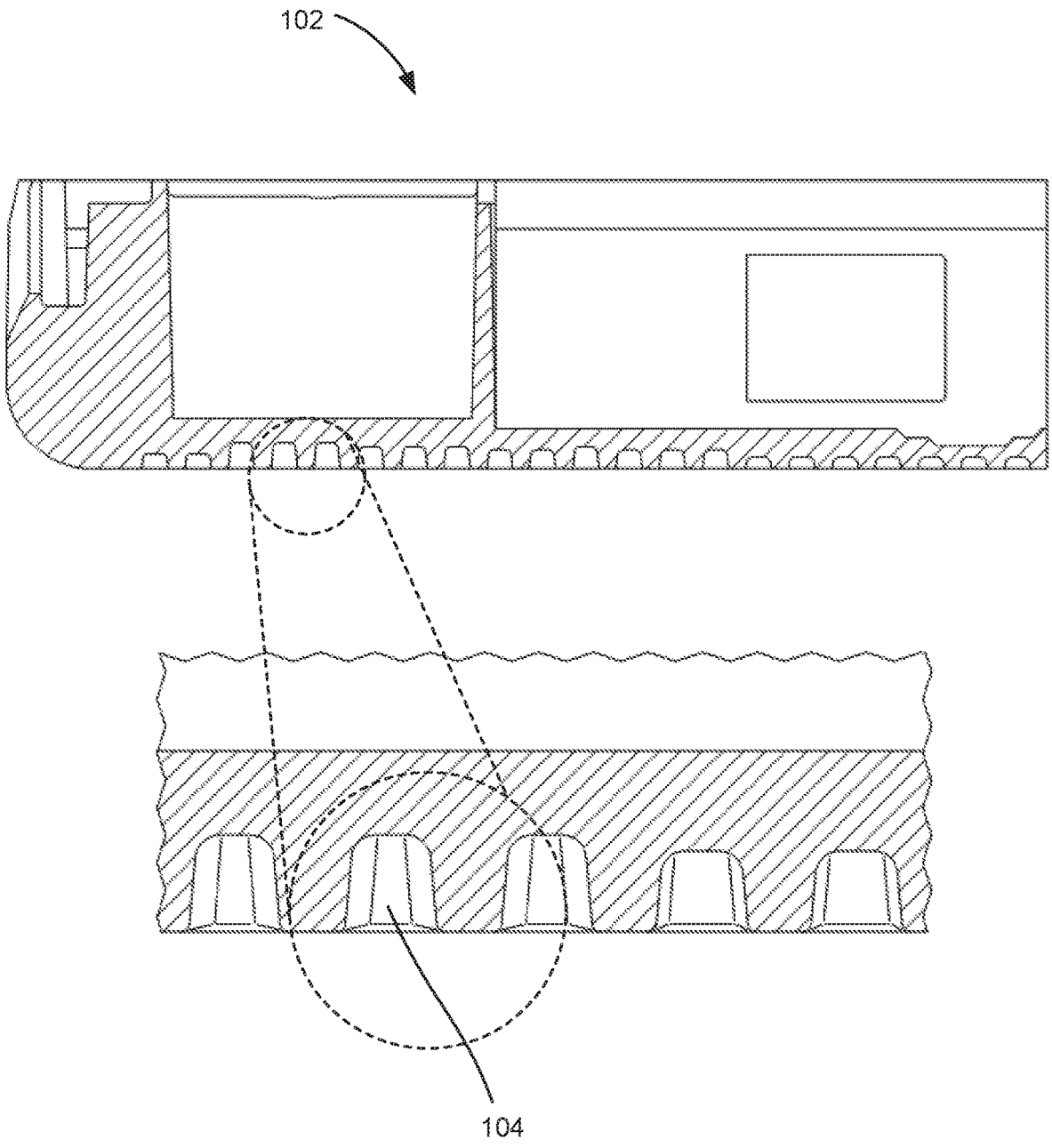
FIG. 2 is a side view of an interconnect of a print liquid supply, according to an example of the principles described herein.
Figure 7:
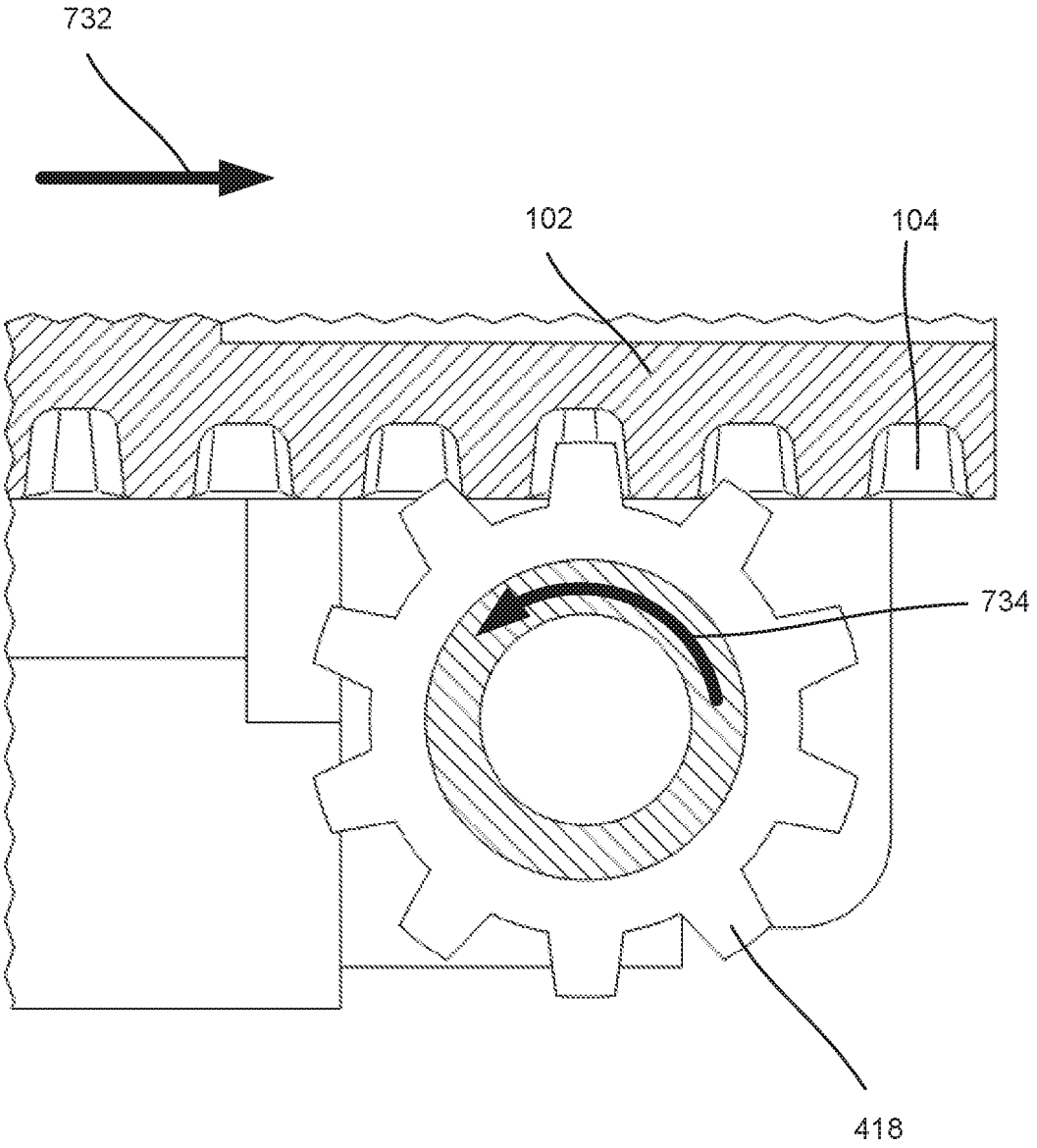
FIG. 7 is a diagram of the rack and pinion of the interconnects of both the print liquid supply and the ejection device, according to an example of the principles described herein.

FIG. 2 is a cross-sectional view of a supply interconnect (102) of a print liquid supply, according to an example of the principles described herein. FIG. 2 clearly depicts the slots (104) in the supply interconnect (102). FIG. 7 below provides an example of a toothed gear interfacing with the slots (104) in the supply interconnect (102).

FIG. 3 is a cross-sectional view of a supply interconnect (102) on a print liquid supply (FIG. 1, 100), according to an example of the principles described herein. Specifically, FIG. 3 depicts the liquid interface (306) which establishes the liquid path between the print liquid supply (FIG. 1, 100) and the ejection device. Specifically, the liquid interface (306) may include a spout and a number of channels that enable print liquid disposed within a reservoir to be passed to an ejection device. The liquid interface (306) also includes a port, or other mechanism by which liquid is expelled from the reservoir. For example, the port may include a septum which is pierced by the needle, or a valve which is opened by the needle such that liquid can be expelled. In FIG. 3, the liquid path through the supply interconnect (102) is depicted by the dashed line.

The supply interconnect (102) also includes an electrical interface (308) which matches with an electrical interconnect upon installation of the print liquid supply (FIG. 1, 100) such that data may be transmitted. Data transmitted therein may relate to the print liquid supply (FIG. 1, 100) and/or the print liquid itself. Such information may be used to adjust operation of the printing device and/or authenticate the print liquid and/or print liquid supply (FIG. 1, 100) to prevent counterfeit use. The electrical interface (308) may include memory to store information and electrical traces to allow the memory to be read, or to be written to.

In some examples, the supply interconnect (102) includes a guide feature (310). The guide feature (310) on the supply interconnect (102) mates with a corresponding feature on the device interconnect to ensure proper alignment of the respective components. That is, each of the supply (FIG. 1, 100) and the printer include various components that mate with each other to 1) establish a liquid path and 2) establish a data transmission path. If these components are not aligned liquid transport and data transmission may be effected and in some cases precluded. Accordingly, the alignment feature (310) which may be a slot in the supply interconnect (102) may mate with a corresponding protrusion in the device interconnect to ensure proper alignment of these components. Note that while particular reference is made to a slot guide feature (310) in the supply interconnect (102) and a protrusion on the device interconnect, these physical configurations may be switched, or other configurations may be used.

Figure 4:
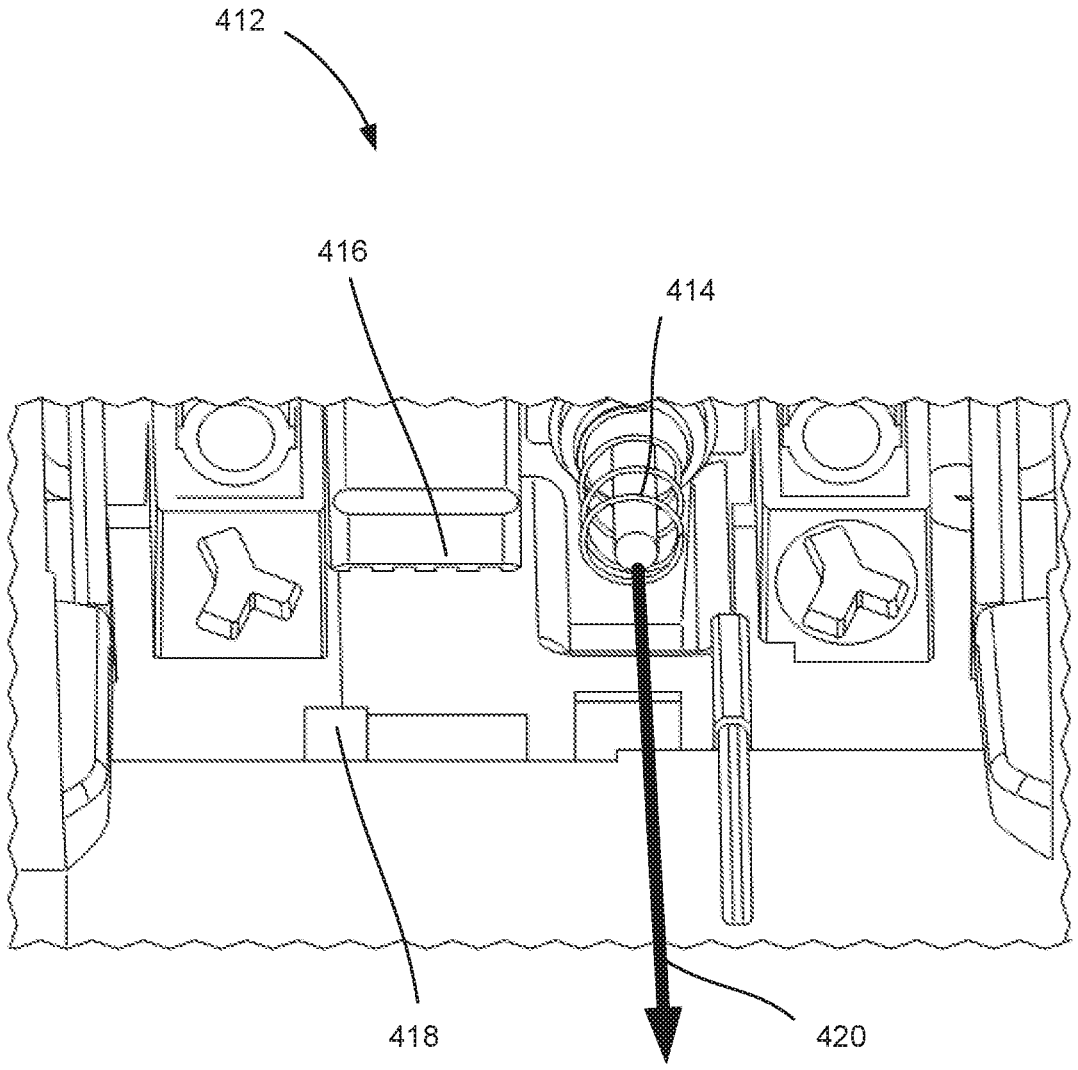
FIG. 4 is a diagram of an interconnect on an ejection device, according to an example of the principles described herein.

FIG. 4 is a diagram of an interconnect (412) on an ejection device, according to an example of the principles described herein. The interconnect (412) on the ejection device may be referred to as an ejection device interconnect (412) or simply a device interconnect (412). When paired with the supply interconnect (FIG. 1, 102), the device interconnect (412) establishes a mechanical, electrical, and fluidic connection between a print liquid supply (FIG. 1, 100) and the ejection device that ejects the print liquid. To facilitate such a connection, the device interconnect (100) includes multiple components.

Specifically, the device interconnect (412) includes a needle (414) to be inserted into a print liquid supply (FIG. 1, 100). The needle (414) may be hollow and allow print liquid to pass there through. The print liquid may be drawn by any number of mechanisms. For example, gravity or a pump may operate to draw the print liquid from the print liquid supply (FIG. 1, 100), through the needle (414), and to the ejection device.

As mentioned above, the needle (414) may be inserted into the print liquid supply (FIG. 1, 100). For example, the needle (414) may pierce a septum on the print liquid supply (FIG. 1, 100) and be put in fluidic communication with the supply (FIG. 1, 100). In another example, a valve or gasket may be present on the print liquid supply (FIG. 1, 102) and the needle (414) may pass through the valve or gasket.

The device interconnect (412) also includes an electrical interface (416) to establish a data transmission path between the print liquid supply (FIG. 1, 100) and the ejection device. The electrical interface (416) of the device interconnect (412) mates with the electrical interface (FIG. 3, 308) of the supply interconnect (FIG. 1, 102) as the print liquid supply (FIG. 1, 100) is inserted into the printing device.

Many different types of data may be transmitted via this connection. For example, information regarding a formulation of the ink, a level of fluid within the print liquid supply (FIG. 1, 100), etc. may be included on a chip of the print liquid supply (FIG. 1, 100). This information may be passed to the printer to verify the print liquid supply (FIG. 1, 100) or to adjust the operation of fluidic ejection in order to optimize the fluidic ejection. In some examples, the electrical interface (416) is disposed between the needle (414) and a second keyed slot however, in other examples the electrical interface (416) may be otherwise oriented. While specific reference is made to particular pieces of information, additional pieces of data can also be transferred via the electrical interface (416).

The device interconnect (412) also includes a rotary motion damper (418) to dampen, via a controlled counter rotation, a tangential force. That is, as described above, an ejection force, which may be tangential to the surface of the rotary motion damper (418) may be too large for small supplies (FIG. 1, 100) such that the small supply (FIG. 1, 100) would eject at a faster than intended velocity. The rotary motion damper (418) counteracts this effect by resisting the motion of the ejection system of the device interconnect (412). In some examples, the rotary motion damper (418) may be a toothed gear that interfaces with the slots (FIG. 1, 104) of the supply interconnect (FIG. 1, 102). In another example, the rotary motion damper (418) may not have teeth, but may be a wheel with a surface treatment. For example the surface of a wheel may be covered with a rubber surface and/or a knurled surface to create surface friction with the supply interconnect (FIG. 1, 102). In this example, the wheel with the surface treatment may interface with the friction material (FIG. 1, 103) or the relief surface (FIG. 1, 105) to reduce the ejection force.

The rotary motion damper (418) may dampen motion via a number of different mechanisms. For example, the rotary motion damper (418) may include a coil spring disposed therein that is biased against the tangential force, which tangential force is indicated by the arrow (420). In another example, the rotary motion damper (418) may dampen motion via a greased shaft. That is, the rotary motion damper (418) may include a cylindrical shaft which is disposed in a slightly larger cylindrical housing. Grease may be disposed between the two. The viscosity of the grease between the shaft and the housing and the friction therein may limit the rotation of the rotary motion damper (418) to a certain radial velocity. Accordingly, the diameters, lengths, gaps, and grease may be selected to impart a desired level of radial velocity that is suitable for all sizes of print liquid supplies (FIG. 1, 100) anticipated to be used with the printing device. While specific reference is made to particular mechanisms of damping the ejection force, the rotary motion damper (418) may include any number of mechanisms to dampen the ejection force resulting from an uncompressing of springs within the printing device.

Figure 5:
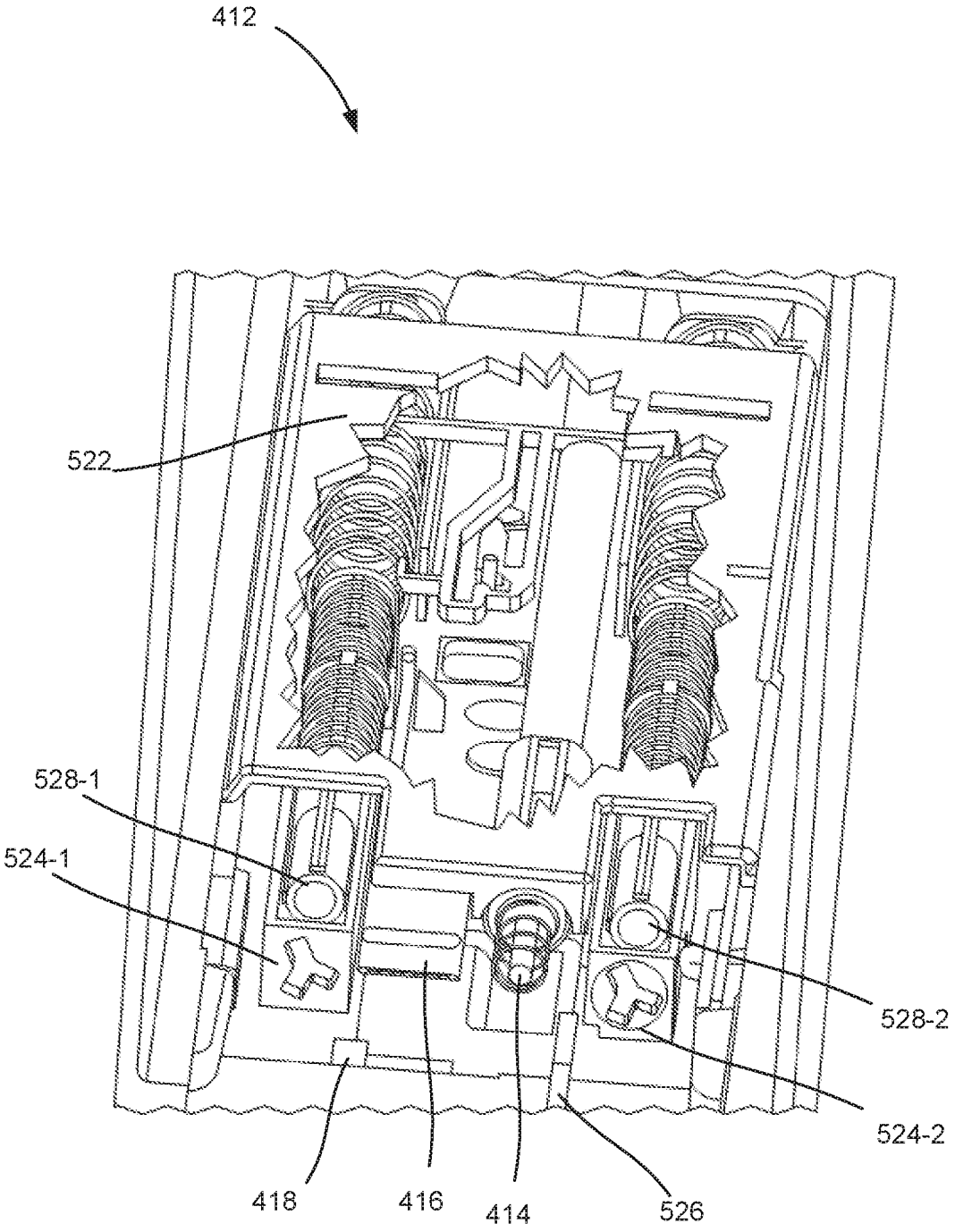
FIG. 5 is a diagram of an interconnect on an ejection device, according to an example of the principles described herein.

FIG. 5 is a diagram of an interconnect (412) on an ejection device, according to an example of the principles described herein. FIG. 5 depicts the needle (414), electrical interface (416), and rotary motion damper (418) as described above. In some examples, the device interconnect (412) includes additional components. Specifically, the device interconnect (412) also, in some examples, includes a guide feature (526) adjacent to the needle (414) to guide an incoming print liquid supply. As described above, the device interconnect (FIG. 1, 102) has a corresponding device that mates with the guide feature (526) to ensure alignment of various liquid, mechanical, and electrical interfaces. While FIG. 5 depicts the guide feature (526) as a protrusion, the guide feature (526) may be any feature such as a slot.

In some examples, the supply interconnect (412) also includes a retractable plate (522). The retractable plate (522) has two positions, a retracted position and an extended position. The retractable plate (522) may be in the extended position when the port is empty, which is when a print liquid supply (FIG. 1, 100) is not disposed therein. In the extended position, that is when a print liquid supply (FIG. 1, 100) is not present, the retractable plate (522) extends past the needle (414) and the electrical interface (416) to protect them. That is, the needle (414) may be a fragile component as may the circuitry that makes up the electrical interface (416). Accordingly, the retractable plate (522) may extend past these components to prevent any mechanical force from damaging these components.

In a retracted position, that is when a print liquid supply (FIG. 1, 100) is inserted, the retractable plate (522) retracts to 1) expose the needle (414) to the print liquid supply (FIGS. 1, 100) and 2) expose the electrical interface (416) to a corresponding interface (FIG. 3, 308) on the supply interconnect (FIG. 1, 102). In some examples, 1) the retraction of the retractable plate (522), 2) insertion of the needle (414) into the print liquid supply (FIGS. 1, 100), and 3) interface of the electrical interface (416) with an electrical interface (FIG. 3, 308) on the print liquid supply (FIG. 1, 100) occur simultaneously.

In this example, the device interconnect (412) includes a latch assembly. The latch assembly is actuated by insertion of protrusions on the supply interconnect (FIG. 1, 102) into keyed slots (524) on the device interconnect (412). The latch assembly controls the movement of the retractable plate (522). In some examples, the two keyed slots (524-1, 524-2) are disposed on either side of the needle (414) to gate insertion of a print liquid supply (FIG. 1, 100) with protrusions that match the keyed slots (524). That is, the keyed slots (524) 1) allow matching protrusions to act upon rods to actuate the retractable plate (522) and 2) prevent non-matching protrusions from acting upon the rods. As can be seen in FIG. 5, in some examples, the needle (414), electrical interface (416), and keyed slots (524) extend from the same plane and the rotary motion damper (418) is disposed below that plane.

To actuate the latch assembly, the device interconnect (412) includes rods (528-1, 528-2) disposed behind each keyed slot (104). That is, a first rod (528-1) is disposed behind a first keyed slot (524-1) and a second rod (528-2) is disposed behind a second keyed slot (524-2). The rods (528) are mechanically coupled to the retractable plate (522). When acted upon by protrusions on the print liquid supply (FIG. 1, 102), the rods (528) retract the retractable plate (522). For example, protrusions on the print liquid supply (FIG. 1, 100) may have a particular shape. If that shape matches the keyed slots (524) the protrusions pass through the keyed slots (524). Once through the keyed slots (524), those protrusions push on the rods (528). The movement of these rods (528) actuates the latch assembly which moves the retractable plate (522) and retains it in a retracted state. Specifically, as the rods (528-1, 528-2) slide backwards, wireforms in the latch assembly disengage from the plate (522). That is, in the extended position, these wireforms are engaged with the plate (522) to prevent unwanted retraction. Disengagement of the wireforms via the movement of the rods (528) allows the plate (522) to fully retract.

A plate latch interfaces with the retractable plate (522) and guides the motion of the retractable plate (522). Specifically, as the retractable plate (522) is pushed backwards, the end of the plate latch moves within a track and also retains the retractable plate (522) in a retracted state. With an additional push by the user in the same direction, the plate latch continues to move in the track so as to allow the retractable plate (522) to return to the extended position.

A supply latch of the latch assembly similarly moves in a latch track. During insertion, a protrusion on the supply latch is moved out of the way such that the print liquid supply (FIG. 1, 100) can be inserted. The latch track is such that as the print liquid supply (FIG. 1, 100) is fully seated, the hook on the supply latch interfaces with a slot on the supply interconnect (FIG. 1, 102) to mechanically retain the print liquid supply (FIG. 1, 100) in a predetermined position in the port.

Figure 6:
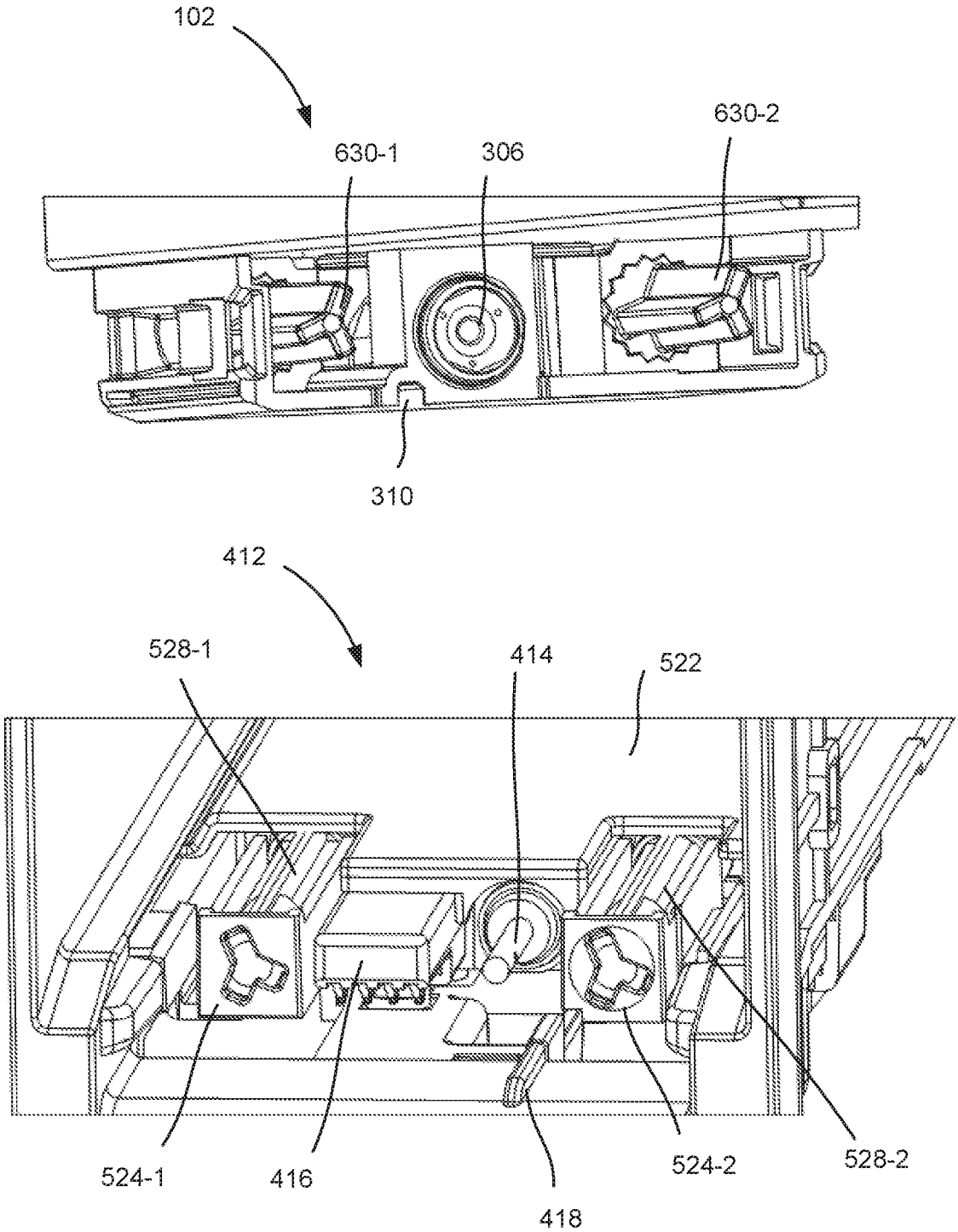
FIG. 6 is a diagram of the interconnects of both a print liquid supply and an ejection device, according to an example of the principles described herein.

FIG. 6 is a diagram of the interconnects (102, 412) of both a print liquid supply and an ejection device, according to an example of the principles described herein. FIG. 6 clearly depict the protrusions (630-1, 630-2) of the supply interconnect (102) that interface to retract the retractable plate (522). Upon insertion, the protrusions (630), if they match the keyed slots (524-1, 524-2), press against the rods (528-1, 528-2) to retract the retractable plate (522) to a state wherein upon further insertion the needle (414) and electrical interface (416) interact with corresponding components on the print liquid supply (FIG. 1, 100) to facilitate liquid delivery. As depicted in FIG. 6, the protrusions (630) have a size and shape that are unique to particular keyed slots (524). If the protrusions (630) match a size and shape of associated keyed slots (524-1,524-2), the protrusions (630) may pass through and interface, i.e., push, the rods (528).

The particular shape and size of the slots (524) and protrusions (630) may be unique to a particular type of liquid. For example, the shape and size may relate to a particular color of ink that is intended to be inserted into that particular port. Accordingly, supply interfaces (102) on print liquid supplies (FIG. 1, 100) with different color ink would have different shaped and sized protrusions (630) and therefore would not be able to be inserted into the port on account of not matching up with the associated keyed slots (524). Put another way, the keyed slots (524) gate insertion of print liquid supplies (FIG. 1, 100) into the device interconnect (412). That is, a printer may have ports into which print liquid supplies (FIG. 1, 100) are disposed. It may be desirable that certain types of liquid be inserted into particular ports.

As a specific example, where the print liquid is ink, it may be desirable that certain colors of ink are disposed in certain ports. Accordingly, via the keyed slots (524) it may be ensured that just a desired print liquid supply (FIG. 1, 100) is inserted into a particular port. That is, the keyed slots (524) may be unique to a particular type of liquid, such as a particular color and/or type of ink. A print liquid supply (FIG. 1, 100) of that liquid type or color of ink may have protrusions (630) that match the shape of the keyed slots (524). In this example, those similarly-shaped protrusions (630) fit into the keyed slots (524) and can therefore interface with the interconnect. By comparison, if a user tries to insert a print liquid supply (FIG. 1, 100) of a different type or a different color ink into that port, the protrusions (630) would not match the keyed slots (524) and that different print liquid supply (FIG. 1, 100) would not be insertable into that particular port. Put another way, the two keyed slots (524-1, 524-2) may be unique to a particular type of liquid, such as a unique color of ink. In one example, the keyed slots (524) are disposed on either side of the needle (414).

FIG. 7 is a diagram of the rack and pinion system of the interconnects (FIG. 1, 102, FIG. 4, 412) of both the print liquid supply (FIG. 1, 100) and the ejection device, according to an example of the principles described herein. As described above, springs within the device interconnect (FIG. 4, 412), upon activation via a user push, may exert a force (732) in an ejection direction. The rotary motion damper (418) to counteract this force, may be biased to have a force (734) in the opposite direction. While the ejection force (732) may be greater than the force (734) of the rotary motion damper (418), the force (734) of the rotary motion damper (418) may reduce the ejection force (732) so as to reduce the ejection velocity of the print liquid supply (FIG. 1, 100) coupled to the supply interconnect (102). While FIG. 7 specifically depicts an ejection force (732) and an opposing force (734) from the rotary motion damper (418), the same rotary motion damper (418) may also slow an insertion speed of the print liquid supply (FIG. 1, 100) to protect components of both systems from potential damage that could result from too quick an insertion velocity. In some examples, the rotary damper can be selected that imposes a damping force that is different on insertion and ejection. FIG. 7 also depicts the interaction of the toothed gear rotary motion damper (418) and the slots (104) of the supply interconnect (102). As described above, the counterforce (734) can be provided by any number of mechanisms including a coil spring and/or a greased shaft disposed in a housing.

Figure 8:
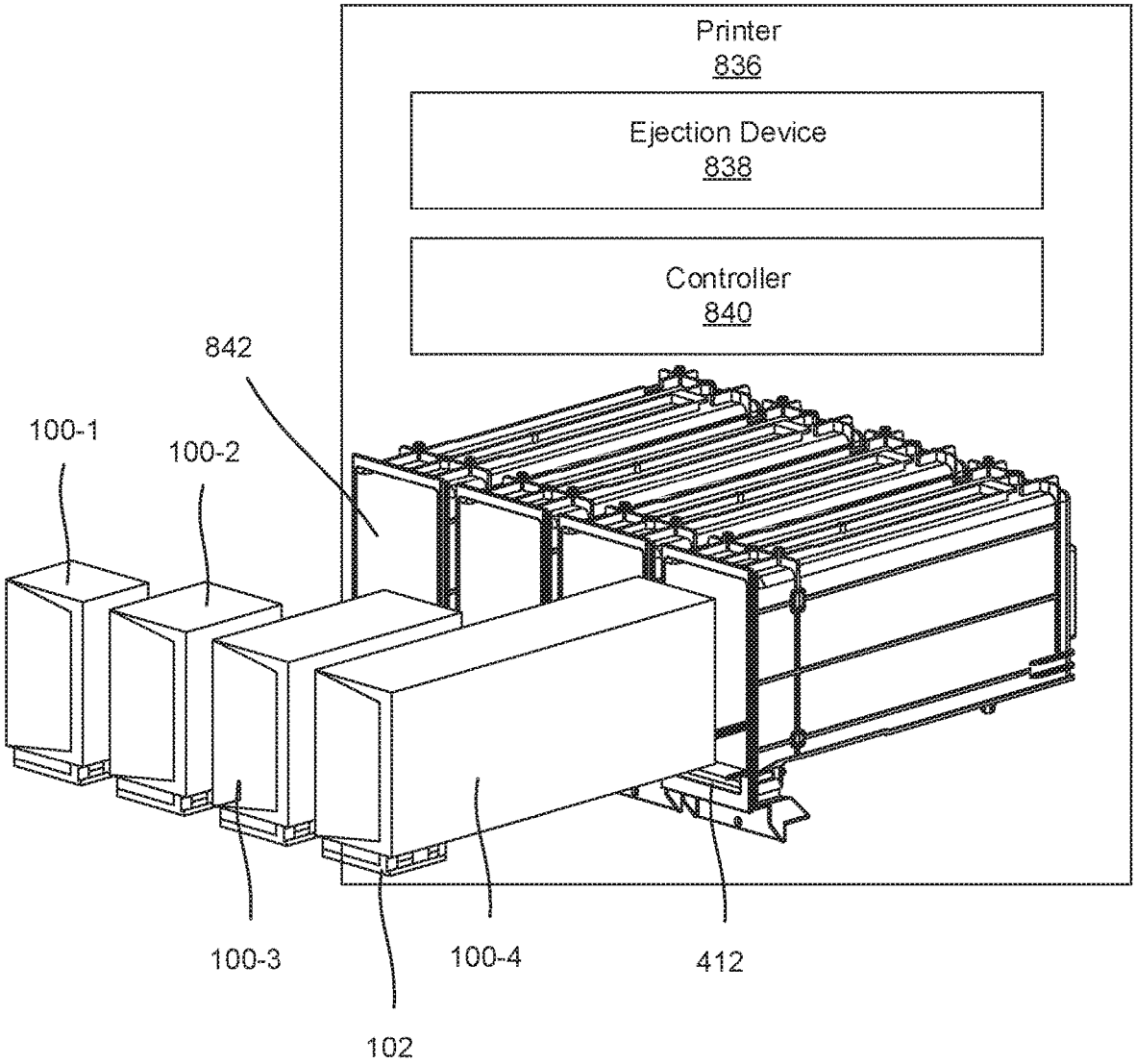
FIG. 8 is a diagram of a printer with multiple print liquid supplies, according to an example of the principles described herein.

FIG. 8 is a diagram of a printer (836) with multiple print liquid supplies (100-1, 100-2, 100-3, 100-4), according to an example of the principles described herein. As described above, an ejection device (838) operates to eject fluid onto a substrate. The ejection device (838) may operate based on any number of principles. For example, the ejection device (838) may be a firing resistor. The firing resistor heats up in response to an applied voltage. As the firing resistor heats up, a portion of the fluid in an ejection chamber vaporizes to generate a bubble. This bubble pushes fluid out an opening of the fluid chamber and onto a print medium. As the vaporized fluid bubble collapses, fluid is drawn into the ejection chamber from a passage that connects the ejection chamber to a fluid feed slot, and the process repeats. In this example, the ejection device (838) may be a thermal inkjet (TIJ) device.

In another example, the ejection device (838) may be a piezoelectric device. As a voltage is applied, the piezoelectric device changes shape which generates a pressure pulse in the fluid chamber that pushes the fluid through the chamber. In this example, the ejection device (838) may be a piezoelectric inkjet (PIJ) device.

Such an ejection device (838) may be included in a printer (836) that carries out at least liquid ejection. The printer (836) may include a controller (840) to control operation of the ejection device (838) to deposit the print liquid in a desired pattern. That is, the controller (840) may control the firing of individual ejectors within the ejection device (838) such that a predetermined pattern is formed.

The printer (836) may be any type of printer (836). For example, the printer (836) may be a 2D printer to form images on a two-dimensional substrate. In another example, the printer (836) may be a 3D printer, sometimes referred to as an additive manufacturing device. In an additive manufacturing process, a layer of build material may be formed in a build area. A fusing agent may be selectively distributed on the layer of build material in a pattern of a layer of a three-dimensional object. An energy source may temporarily apply energy to the layer of build material. The energy can be absorbed selectively into patterned areas formed by the fusing agent and blank areas that have no fusing agent, which leads to the components to selectively fuse together.

Additional layers may be formed and the operations described above may be performed for each layer to thereby generate a three-dimensional object. Sequentially layering and fusing portions of layers of build material on top of previous layers may facilitate generation of the three-dimensional object. The layer-by-layer formation of a three-dimensional object may be referred to as a layer-wise additive manufacturing process. In this example, the print liquid provided in a supply, and passing through to the ejection device (212) is an additive manufacturing fabrication agent.

As described above, the printer (836) may include any number of ports (842) to receive different print liquid supplies. While FIG. 8 depicts four ports (842), the printer (836) may include any number of ports (842). For simplicity in FIG. 8, just one port (842) is indicated with a reference number. Each port (842) may accommodate different size print liquid supplies (100) so long as the print liquid supply (100) has a predetermined face shape. For example, the ports (842) may have an aspect ratio of at least 1.5. In this example, each print liquid supply (100) that is inserted may have a similar aspect ratio to match the opening, and increase in volume may be provided by differences in length of the print liquid supplies (100). Accordingly, the dimension of each print liquid supply container (100-1, 100-2, 100-3, 100-4), regardless of the volume, may have a size to fit in the opening. That is, each container (100) depicted in FIG. 8 has a different volume on account of them having different lengths. However, the dimensions of each container (100) that align with the opening in the port is the same. By having the container (100) with the same front surface shape and size, regardless of a length, and therefore volume, a variety of volumes of print supplies (100) can be used in a given supply port (842). That is, rather than being limited to a size of a print supply (100), a port (842) can accept a variety of containers (100) having different volumes, each with the same front surface size and shape.

As depicted in FIG. 8, the printer (836) may include multiple ports (842) and therefore multiple interconnects (412). In this example, each interconnect (412) is associated with a different color of ink and/or different type of liquid. That is, each interconnect (412) may have keyed slots (FIG. 5, 524) with different shapes. Accordingly, just a print liquid supply (100) with the same shaped protrusions (630) may be inserted. Print liquid supplies (100) pertaining to a certain color and/or a certain liquid type may have a certain protrusion shape, which may mate with keyed slots (FIG. 5, 524) of a particular port (842) such that 1) just that color/type can be inserted into that slot, and such that this color/type cannot be inserted into any other port (842). A device interconnect (412) is provided in each port (842).

The printing system also includes the print liquid supplies (100) which include reservoirs and supply interfaces (102) as described above. As described herein, the print liquid supplies (100) provide the print liquid to a printing device or other ejection device.

Such an interconnect system 1) accommodates connection between a printer and any number of print liquid supplies with different volumes, 2) presents the same user experience during ejection of a print liquid supply regardless of the supply size and mass and, 3) provides for simple coupling of a print liquid supply to a printer.

What is claimed is:

1. An interconnect on a print liquid supply comprising:

a liquid interface to establish a liquid path between the print liquid supply and an ejection device in which the print liquid supply is installed;

an electrical interface to establish a data transmission path between the print liquid supply and the ejection device; and an external surface of the interconnect having a dampening element disposed thereon, the dampening element to counter an ejection force of the print liquid supply.

2. The interconnect of claim 1, wherein the dampening element is disposed across a length of the external surface to facilitate dampening of the supply at ejection.

3. The interconnect of claim 2, wherein the dampening element is disposed across at least fifty percent of the length of the external surface.

4. The interconnect of claim 1, wherein the dampening element comprises a number of slots.

5. The interconnect of claim 4, wherein the slots are disposed across an entirety of the external surface.

6. The interconnect of claim 4, wherein the slots are disposed just across a portion of the external surface that interfaces with a rotary motion damper.

7. The interconnect of claim 4, wherein the slots are a rack of a rack and pinion motion damper.

8. The interconnect of claim 1, wherein the dampening element comprises a friction surface.

9. The interconnect of claim 1, wherein the dampening element comprises a relief surface.

10. The interconnect of claim 1, further comprising a guide feature to align the print liquid supply during installation into the ejection device.

11. The interconnect of claim 1, further comprising protrusions to match keyed slots in an ejection device interconnect and to act upon rods in the ejection device interconnect when matched with corresponding keyed slots.

12. The interconnect of claim 11, wherein a size and shape of the protrusions are unique to the keyed slots.

13. The interconnect of claim 11, further comprising:

a retractable plate to:

when a print liquid supply is not present, extend past the needle and electrical interface to protect from mechanical damage; and when a print liquid supply is inserted, retract to:

expose the needle to the print liquid supply; and expose the electrical interface to a corresponding interface on the print liquid supply; and a latch assembly actuated by insertion of the protrusions in the two keyed slots, wherein the latch assembly controls the movement of the retractable plate.

14. The interconnect of claim 11, further comprising two keyed slots disposed on either side of the needle to gate insertion to a print liquid supply with protrusions that match the two keyed slots, wherein the two keyed slots are to:

allow matching protrusions to act upon the rods; and prevent non-matching protrusions from acting upon the rods.

15. An interconnect on an ejection device comprising:

a needle to be inserted into a print liquid supply to allow print liquid from the print liquid supply to pass to the ejection device;

an electrical interface to establish a data transmission path between the print liquid supply and the ejection device; and a rotary motion damper to dampen, via a controlled counter-rotation, a tangential spring-based ejection force.

16. The interconnect of claim 15, wherein the rotary motion damper is a one of a toothed gear, a wheel with a rubber surface, a grit wheel and a knurled wheel.

17. The interconnect of claim 15, wherein the rotary motion damper dampens the tangential force via a coil spring.

18. The interconnect of claim 15, wherein the rotary motion damper dampens the tangential force via a greased shaft.

19. A printing system comprising:

a printer comprising:

an ejection device to deposit print liquid onto a substrate;

a controller to control operation of the ejection device to deposit the print liquid in a desired pattern; and an interconnect comprising:

a needle to be inserted into a print liquid supply to allow print liquid from the print liquid supply to pass to the ejection device;

an electrical interface to establish a data transmission path between the print liquid supply and the ejection device; and a rotary motion damper to dampen, via a controlled counter-rotation, a tangential spring-based ejection force; and a print liquid supply comprising:

a reservoir to hold the print liquid; and an interconnect on a print liquid supply comprising:

a liquid interface to establish a liquid path between the print liquid supply and an ejection device in which the print liquid supply is installed;

an electrical interface to establish a data transmission path between the print liquid supply and the ejection device; and a number of slots formed on an external surface of the interconnect;

wherein the slots and the rotary motion damper form a rack and pinion.

20. The system of claim 19, wherein the rack and pinion slow the ejection speed and insertion speed of the print liquid supply.

* * * * *